US006162540A

United States Patent [19]

Tsuji et al.

[11] Patent Number: 6,162,540

[45] Date of Patent: Dec. 19, 2000

[54] INSULATED WIRE

[75] Inventors: Kazunori Tsuji; Masashi Sato, both of Yokkaichi, Japan

[73] Assignee: Sumitomo Wiring Systems, Ltd., Japan

[21] Appl. No.: 09/527,902

[22] Filed: Mar. 20, 2000

[30] Foreign Application Priority Data

Mar. 23, 1999 [JP] Japan ..... 11-077959

[51] Int. Cl.[7] ..... D07B 1/00; D07B 3/00

[52] U.S. Cl. ..... 428/375; 428/379; 174/110 SR; 174/110 V; 174/113 R

[58] Field of Search ..... 428/375, 379, 428/372; 174/110 SR, 110 V, 113 R

[56] References Cited

U.S. PATENT DOCUMENTS

| | | | |
|---|---|---|---|
| 4,427,816 | 1/1984 | Aoki et al. | 524/357 |
| 5,270,366 | 12/1993 | Hein . | |
| 5,326,638 | 7/1994 | Mottine, Jr. et al. . | |
| 5,756,570 | 5/1998 | Hoch et al. . | |

FOREIGN PATENT DOCUMENTS

| | | |
|---|---|---|
| 0 656 634 | of 1995 | European Pat. Off. . |
| 0 768 336 | of 1997 | European Pat. Off. . |
| 5-001195 | of 1993 | Japan . |
| 6-080849 | of 1994 | Japan . |
| 9-324088 | of 1997 | Japan . |
| 11-240992 | of 1999 | Japan . |
| WO 96/36663 | of 1996 | WIPO . |

*Primary Examiner*—N Edwards
*Attorney, Agent, or Firm*—Anthony J. Casella; Gerald E. Hespos; Michael J. Porco

[57] ABSTRACT

An insulated wire is provided with excellent heat stability and strippability. The wire is coated by a resin composition obtained by mixing 10 parts by weight or less of calcium-zinc stabilizer, 2 to 10 parts by weight of hydrotalcite and 0.1 to 1 part by weight of stearic acid to 100 parts by weight of vinyl chloride resin. This wire is most effective when the size thereof is 0.3 to 2 $mm^2$ and the thickness of its insulation coating is 0.2 to 0.5 mm.

7 Claims, 1 Drawing Sheet

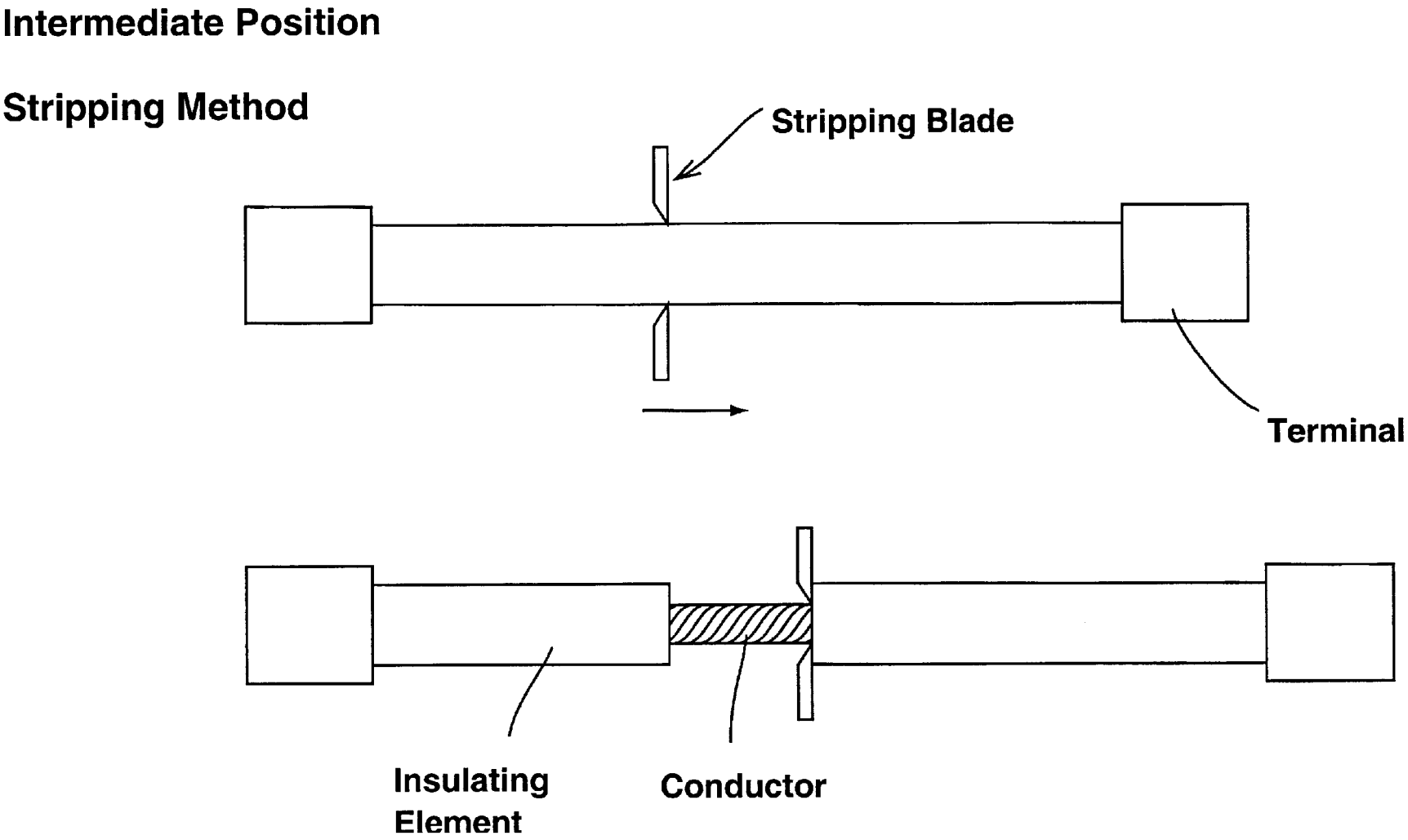
Intermediate Position
Stripping Method

INSULATED WIRE

BACKGROUND OF THE INVENTION

1. Field of the Invention

The present invention relates to an insulated wire coated with a vinyl chloride resin composition free from lead compounds. More particularly, the present invention relates to an insulated wire for automotive vehicles.

2. Description of the Related Art

Conventionally, vinyl chloride resin compositions generally obtained by adding a stabilizer, a lubricant, etc. to a polyvinyl chloride (PVC) have been used as insulation coatings and sheaths of automotive wires due to their suitable flexibility and abrasion resistance. Stabilizers used in the vinyl chloride resins include, for example, tribasic lead sulfate, dibasic lead phosphite, and lead silicate, whereas lubricants used therein include lead stearate. Such lead compounds are frequently used.

When an automotive vehicle is scrapped, wiring harnesses comprised of automotive wires and the like are shredded into dust and buried in the ground. However, since lead compounds contained in the stabilizer and the lubricant are eluted from the buried dust by rainwater, they may cause an environmental pollution. To avoid these problems, there has been an increasing tendency in recent years to use lead-free stabilizers. For example, calcium-zinc stabilizers are used as the lead-free stabilizer. The heat resistance and the weather resistance of the vinyl chloride resin coating have been improved by using hydrotalcite together with the calcium-zinc stabilizer.

However, the vinyl chloride resin mixed with hydrotalcite, adheres more strongly to a copper conductor than prior art wire coatings. This stronger adherence can cause a problem. More specifically, insulation stripping operations are essential to a wiring harness manufacturing operation. Such an intermediate stripping operation involves making a cut in an insulation coating at an intermediate position of the wire and displacing the cut insulation coating to provide a space required for a crimping operation. However, the above-described insulation coating is strongly adhered to the copper conductor and may be torn or cracked during the stripping operation or may corrugate without smoothly moving along the copper conductor during the stripping operation. If such an event occurs during the intermediate stripping operation, a terminal cannot be crimped at the intermediate position of the wire. This, of course, is a critical problem to the wiring harness manufacturing operation.

In view of the above situation, an object of the present invention is to provide an insulated wire having an insulation coating which has an improved heat stability and an excellent strippability.

SUMMARY OF THE INVENTION

The invention is directed to an insulated wire coated by a vinyl chloride resin composition comprising 10 parts by weight or less of calcium-zinc stabilizer, 2 to 10 parts by weight of hydrotalcite and 0.1 to 1 part by weight of stearic acid per 100 parts by weight of vinyl chloride resin. The insulated wire according to the present invention can be used for automotive vehicles.

In the present invention, the term "calcium-zinc stabilizer" means a lead-free stabilizer, whose main ingredients are zinc stearate and calcium stearate. Such calcium-zinc stabilizers are well known in the art, as shown, for example, U.S. Pat. No. 5,326,638, the disclosure of which is incorporated herein by reference.

The invention is most effective when the size (cross section area) of the wire is 0.3 to 2 $mm^2$ (excluding its insulation coating) and the thickness of its insulation coating is 0.2 to 0.5 mm.

Preferably, the insulated wire comprises a conductor made of copper or copper alloy, and the conductor may be made by twisting 7 to 26 strands having a diameter of 0.15 mm to 0.35 mm.

Excellent effects can be brought about by mixing 10 parts by weight or less of calcium-zinc stabilizer per 100 parts by weight of vinyl chloride resin, and heat stability and weather resistance can be further improved by admixing hydrotalcite. The content of calcium-zinc stabilizer is 10 parts by weight or less, since abrasion resistance is reduced despite an improved heat stability if it is more than 10 parts by weight. In a preferred embodiment, the vinyl chloride resin composition of the present invention comprises 10 parts by weight to 0.5 parts by weight, more particularly 5.6 parts by weight to 0.6 parts by weight, of calcium-zinc stabilizer. Hydrotalcite in an amount of 2 to 10 parts by weight is mixed per 100 parts by weight of vinyl chloride resin. If the content of hydrotalcite is more than 10 parts by weight, abrasion resistance is reduced although heat stability is improved. Further, if the content of hydrotalcite is less than 2 parts by weight, heat stability is reduced.

Stearic acid is used as a lubricant, and an increasing tendency of adhesiveness to the copper conductor due to the admixture of hydrotalcite can be suppressed by admixing stearic acid. The stearic acid in an amount of 0.1 to 1 part by weight is mixed per 100 parts by weight of vinyl chloride resin. If the content of stearic acid is more than 1 part by weight, a terminal cannot be mounted due to an excessively weak adhesive force and the displaced insulation coating largely tries to return to its initial position after the intermediate stripping operation, thereby disadvantageously causing a variation in the length of the stripped portions. Conversely, if the content of stearic acid is less than 0.1 part by weight, the insulation coating is likely to be cracked and corrugated, as described above, due to an insufficiently reduced adhesiveness.

These and other objects, features and advantages of the present invention will become more apparent upon a reading of the following detailed description and accompanying drawing.

BRIEF DESCRIPTION OF THE DRAWING

The FIGURE is a side view showing a strippability testing method.

DETAILED DESCRIPTION OF THE PREFERRED EMBODIMENT

A vinyl chloride resin used in the invention may be a generally used vinyl chloride resin used as a conventional wire coating material. Normally, vinyl chloride resins having an average polymerization degree of 1300 to 3000 can be used.

A plasticizer to be mixed into the vinyl chloride resin may, for example, contain phthalic acid, trimellitic acid, polyester, or epoxy. However, the plasticizer is not limited to such. Any plasticizer may be used provided that it is compatible with the vinyl chloride resin. One kind of plasticizer may be used alone or two or more kinds of plasticizers may be used in combination. An amount of the plasticizer to be mixed is preferably 20 to 60 parts by weight, more preferably 25 to 55 parts by weight, per 100 parts by weight of the vinyl chloride resin.

Further, a filler may be added. The filler may be, for example, calcium carbonate, clay or the like and less than 50 parts by weight of the filler is preferably mixed per 100 parts by weight of the vinyl chloride resin.

Besides the above agents, an aging inhibitor, an antioxidant, a copper harm preventing agent, a light stabilizer, a flame retardant and the like can be suitably added.

An insulated wire of the present invention can be produced by the same production method as a prior art wire having an insulation coating made of a vinyl chloride resin, using the aforementioned resin composition. Such an insulated wire is most effective when the cross-sectional area of the wire is 0.3 to 2 $mm^2$ and the thickness of its insulation coating is 0.2 to 0.5 mm.

The above-described resin composition enables production of an insulated wire that is excellent both in heat stability and in strippability despite its absence of lead.

As examples 1 to 4 according to the present invention and comparative examples 1 to 6, resin compositions were prepared in which a polyvinyl chloride having a polymerization degree of 1300, Ca—Zn stabilizer, hydrotalcite, stearic acid, zinc stearate, calcium stearate, plasticizer (DIDP=diisodecylphthalate), filler (calcium carbonate) are mixed at ratios shown in TABLE-1. A Ca—Zn stabilizer together with hydrotalcite, for example, can be a product supplied by Asahi Denka Kogyo K.K. under the trademark "Rup", a product supplied by Mizusawa Industrial Chemicals, Ltd. under the trademark STABINEX-NL, and a product supplied by Sakai Chemical Industry Co., Ltd. under the trademark "OW", respectively.

These resin compositions each were applied around a conductor made by twisting 7 strands and having a size of 0.5 $mm^2$ to have a thickness of 0.3 mm, and the strippability, heat stability and abrasion resistance of the obtained wires were estimated.

Strippability Test

An annular cut was made in an insulation coating by a flat blade in such a manner as not to damage the conductor, and a cut portion of the insulation coating was displaced to expose the conductor. Then, estimations were made as to whether there is any crack and/or corrugation in the displaced portion of the insulation coating and whether the displaced portion returns to its initial position after the lapse of time (see the FIGURE).

Heat Stability Test

A heat stability test was conducted in accordance with JIS D6723. After the wire is heated for 2 hours, hydrogen chloride produced by pyrolysis was detected using Congo red as an indicator.

Scrape Resistance Test

A scrape resistance test was conducted by a blade reciprocation method in accordance with JIS D611-94 under the conditions of a temperature of 23° C. and a load of 7 N using the leading end of a blade having a radius of 0.225 mm.

Estimation results are shown in TABLE-1 and TABLE-2.

TABLE-1

| | | EX. 1 | EX. 2 | EX. 3 | EX. 4 |
|---|---|---|---|---|---|
| Resin Comp. | Vinyl Chloride Resin | 100 | 100 | 100 | 100 |
| | DIDP | 40 | 40 | 40 | 40 |
| | Calcium Carbonate | 15 | 15 | 15 | 15 |
| | Ca-Zn Stabilizer | 1.5 | 1.5 | 1.5 | 1.5 |
| | Hydrotalcite | 3.5 | 3.5 | 2 | 10 |
| | Stearic Acid (Lubricant) | 0.1 | 1 | 0.5 | 0.5 |
| | Zinc Stearate (Lubricant) | | | | |
| | Calcium Stearate (Lubricant) | | | | |
| Test Results | Interm. Strippability | O | O | O | O |
| | Heat Stability (Time) | 2< | 2< | 2< | 2< |
| | Abr. Resis. (Times) | 500 | 600 | 550 | 350 |

(Target Values)
Heat Stability: 2 hours
Abrasion Resistance: more than 300 times

TABLE-2

| | | CE. 1 | CE. 2 | CE.3 | CE. 4 | CE. 5 | CE. 6 |
|---|---|---|---|---|---|---|---|
| Resin Comp. | Vinyl Chloride Resin | 100 | 100 | 100 | 100 | 100 | 100 |
| | DIDP | 40 | 40 | 40 | 40 | 40 | 40 |
| | Calcium Carbonate | 15 | 15 | 15 | 15 | 15 | 15 |
| | Ca-Zn Stabilizer | 3.5 | 1.5 | 1.5 | 1.5 | 1.5 | 1.5 |
| | Hydrotalcite | 1.5 | 15 | 3.5 | 3.5 | 3.5 | 3.5 |
| | Stearic Acid (Lubricant) | 0.5 | 1 | | 0.05 | 1.5 | |
| | Zinc Stearate (Lubricant) | | | | | | 1 |
| | Calcium Stearate (Lubricant) | | | | | | 1 |
| Test Results | Interm. Strippability | O | O | x Crack | x Crack | x Return | x Crack |
| | Heat Stability (Time) | 1.5 | 2< | 2< | 2< | 2< | 2< |
| | Abr. Resis. (Times) | 550 | 200 | 500 | 500 | 600 | 500 |

As shown in the respective examples of TABLE-1, the intermediate strippability (easiness to strip the insulation coating in its intermediate position), heat stability and abrasion resistance of the insulation coatings were satisfactory when the contents of calcium-zinc stabilizer, hydrotalcite and stearic acid were within the specified ranges. Contrary to this, in comparative example 1 in which the content of hydrotalcite was below the lower limit of its specified range of 2 to 10 parts by weight, heat stability was not sufficient despite a larger content of stabilizer than the other examples as shown in TABLE-2. Further, abrasion resistance was largely reduced in comparative example 2 in which the content of hydrotalcite exceeded the upper limit of the specified range. Furthermore, in comparative examples 3 and 4 in which the content of stearic acid was below the lower limit of its specified range of 0.1 to 1 parts by weight, strippability was not satisfactory since the conductor and the vinyl chloride resin were strongly adhered to each other. Conversely, in comparative example 5 in which the content of stearic acid exceeded the upper limit of the specified range, the displaced coating returned to its initial position upon the lapse of time due to its weak adhesive force, which caused a problem in mounting a terminal. Further, in comparative example 6 in which zinc stearate as well as calcium stearate were used as lubricants instead of stearic acid as they are the most popular and representative lubricants, the insulation coating could not be satisfactorily stripped due to a strong adhesive force despite a sufficient content of the lubricant.

As described above, according to the invention, an insulated wire having excellent strippability, heat stability and abrasion resistance without containing lead could be obtained by covering a wire by a resin composition obtained by adjusting and mixing a calcium-zinc stabilizer, hydrotalcite and stearic acid to a vinyl chloride resin.

What is claimed is:

1. An insulated wire coated by a vinyl chloride resin composition comprising 10 parts by weight or less of calcium-zinc stabilizer, 2 to 10 parts by weight of hydrotalcite and 0.1 to 1 part by weight of stearic acid per 100 parts by weight of vinyl chloride resin.

2. An insulated wire according to claim 1, which comprises 10 parts by weight to 0.5 parts by weight of calcium-zinc stabilizer per 100 parts by weight of vinyl chloride resin.

3. An insulated wire according to claim 2, which further comprises 20 parts by weight to 60 parts by weight of a plasticizer per 100 parts by weight of vinyl chloride resin.

4. An insulated wire according to claim 3, which further comprises less than 50 parts by weight of a filler per 100 parts by weight of the vinyl chloride resin.

5. An insulated wire according to claim 1, wherein the size thereof is 0.3 to 2 $mm^2$ and the thickness of its insulation coating is 0.2 to 0.5 mm.

6. An insulated wire according to claim 5, comprising a conductor made of copper or copper alloy.

7. An insulated wire according to claim 6, wherein the conductor is made by twisting 7 to 26 strands having a diameter of 0.15 mm to 0.35 mm.

* * * * *